US010404009B2

(12) United States Patent
France et al.

(10) Patent No.: US 10,404,009 B2
(45) Date of Patent: Sep. 3, 2019

(54) CONNECTION AND DISCONNECTION DEVICE

(71) Applicant: ABB SCHWEIZ AG, Baden (CH)

(72) Inventors: Philippe France, Chazelles sur Lyon (FR); Romain Villard, Tassin la Demi Lune (FR)

(73) Assignee: TYCO ELECTRONICS SERVICES GMBH, Schaffhausen (CH)

( * ) Notice: Subject to any disclaimer, the term of this patent is extended or adjusted under 35 U.S.C. 154(b) by 0 days.

(21) Appl. No.: 16/002,670

(22) Filed: Jun. 7, 2018

(65) Prior Publication Data

US 2018/0358745 A1 Dec. 13, 2018

(30) Foreign Application Priority Data

Jun. 8, 2017 (EP) ..... 17175009

(51) Int. Cl.

| | |
|---|---|
| ***H01R 13/627*** | (2006.01) |
| ***H01R 13/631*** | (2006.01) |
| ***H01R 13/506*** | (2006.01) |
| *H01R 13/74* | (2006.01) |

(52) U.S. Cl.

CPC ..... *H01R 13/6273* (2013.01); *H01R 13/506* (2013.01); *H01R 13/631* (2013.01);

(Continued)

(58) Field of Classification Search

CPC ..... H01R 13/6273; H01R 13/506; H01R 13/631; H01R 13/743; A47B 2200/0077; A47B 2200/0083

(Continued)

(56) References Cited

U.S. PATENT DOCUMENTS 6,241,551 B1 6/2001 Watanabe
6,579,111 B2 * 6/2003 Fukamachi ..... H01R 13/62933 439/247

(Continued)

FOREIGN PATENT DOCUMENTS

DE 2020157937 U1 2/2017

OTHER PUBLICATIONS

International Search Report for Application No. EP 17175009.
Machine English Translation Abstract DE202015007937.
Written Opinion for Application No. EP 17175009.

*Primary Examiner* — Khiem M Nguyen
(74) *Attorney, Agent, or Firm* — Cantor Colburn LLP

(57) ABSTRACT

A device for connecting and disconnecting an electrical apparatus by a first line and a second line, the device comprising a first part, carrying at least one first pole belonging to the first line; a second part, carrying at least one second pole belonging to the first line; the first part being movable relative to the second part in a connection and disconnection direction; a movable support guided in movement with respect to the first part, the support carrying at least one first pole belonging to the second line; the second part carrying at least one second pole belonging to the second line; at least one lock for securing the support with respect to the first part; the connection and disconnection device defining a first operating area in which: the at least one first pole belonging to the first line is in contact with the at least one second pole belonging to the first line so as to close the first line, and the at least one first pole belonging to the second line is in contact with the at least one second pole belonging to the second line so as to close the second line, the distance separating the first part from the second part being less than a first threshold; the connection and disconnection device defining a second operating area in (Continued)

which: the at least one first pole belonging to the first line is separated from the at least one second pole belonging to the first line so as to open the first line, and the at least one first pole belonging to the second line is in contact with the at least one second pole belonging to the second line so as to close the second line, the distance separating the first part from the second part being comprised between the first threshold and a second threshold; the connection and disconnection device defining a third operating area in which: the at least one first pole belonging to the first line is separated from the at least one second pole belonging to the first line so as to open the first line, and the at least one first pole belonging to the second line is separated from the at least one second pole belonging to the second line so as to open the second line, the distance separating the first part from the second part being greater than the second threshold; the at least one lock being configured to secure the support and the first part when the distance separating the first part and the second part becomes greater than the second threshold, and to detach the support from the first part when the distance separating the first part and the second part becomes less than or equal to the second threshold.

20 Claims, 4 Drawing Sheets

(52) U.S. Cl.
CPC ..... *A47B 2200/0077* (2013.01); *A47B 2200/0083* (2013.01); *H01R 13/743* (2013.01)

(58) Field of Classification Search
USPC ..... 439/345, 357, 540.1, 660
See application file for complete search history.

(56) References Cited

U.S. PATENT DOCUMENTS

2015/0380881 A1 12/2015 Tanigawa
2016/0093972 A1 3/2016 Akagi et al.

* cited by examiner

CONNECTION AND DISCONNECTION DEVICE

CROSS REFERENCE TO RELATED APPLICATIONS

This application claims priority under 35 U.S.C. 119 to the following European Patent Application No. 17175009.4 filed on Jun. 8, 2017, the contents of which are incorporated herein by reference thereto.

TECHNICAL FIELD

The present invention concerns the field of the electrical junction, and more particularly of the connection/disconnection of an electrical apparatus to an electrical current source and to a control equipment.

BACKGROUND

It is often necessary to be able to plug an electrical apparatus not only into an electrical current source, but also into a test and control equipment of the apparatus, after previously unplugging it from the current source. To this end, it is in particular known to use a first junction line intended to the plugging of the apparatus into the electrical current source, and a second junction line intended to the plugging of the apparatus into the control equipment, the closing or the opening of each line being ensured by separate junction means. The junction means are fixed to a first portion of a movable slide member located facing a corresponding second portion of a stationary cabinet. Each junction means is provided with connection male poles on a face of the portion of the movable slide member, cooperating with female poles positioned on the second portion of the stationary cabinet, such that the male poles are inserted into the corresponding female poles when the two portions are brought closer to each other. The male poles of the second junction means are longer than the male poles of the first junction means. Thus, when the two portions of the movable slide member and the stationary cabinet are sufficiently close to each other, the male poles of the first junction means are in contact with the female poles of the power source, and the apparatus is then plugged thereinto and can operate normally; when the movable slide member is sufficiently deviated from the portion of the stationary cabinet on which the female poles are fixed, then all the male poles are separated from their corresponding female pole. However, in an intermediate position of the movable slide member, for which the distance between the two portions is comprised between the length of the shortest male poles, and the length of the longest male poles, the male poles of the first junction means are not in contact with the female poles corresponding thereto, while the male poles of the second junction means are in contact with the female poles corresponding thereto. In this position of the slide member, the apparatus is unplugged from the current source and can be joined, via the second junction means, to the test and control equipment.

This solution, based on the use of sliding contacts, requires the application of a significant pressure on the contact areas between the poles to ensure a good contact quality, which pressure is not very compatible with the desired sliding.

BRIEF SUMMARY

The invention therefore aims to propose a solution to this problem.

To this end, the present invention concerns a device for connecting and disconnecting an electrical apparatus by a first line and a second line, the device comprising:

- a first part, carrying at least one first pole belonging to the first line;
- a second part, carrying at least one second pole belonging to the first line;
- the first part being movable relative to the second part in a connection and disconnection direction;
- a movable support guided in movement with respect to the first part, the support carrying at least one first pole belonging to the second line;
- the second part carrying at least one second pole belonging to the second line;
- at least one lock for securing the support with respect to the first part;

the connection and disconnection device defining a first operating area in which:

- the at least one first pole belonging to the first line is in contact with the at least one second pole belonging to the first line so as to close the first line, and
- the at least one first pole belonging to the second line is in contact with the at least one second pole belonging to the second line so as to close the second line,
- the distance separating the first part from the second part being less than a first threshold;

the connection and disconnection device defining a second operating area in which:

- the at least one first pole belonging to the first line is separated from the at least one second pole belonging to the first line so as to open the first line, and
- the at least one first pole belonging to the second line is in contact with the at least one second pole belonging to the second line so as to close the second line,
- the distance separating the first part from the second part being comprised between the first threshold and a second threshold;

the connection and disconnection device defining a third operating area in which:

- the at least one first pole belonging to the first line is separated from the at least one second pole belonging to the first line so as to open the first line, and
- the at least one first pole belonging to the second line is separated from the at least one second pole belonging to the second line so as to open the second line,
- the distance separating the first part from the second part being greater than the second threshold;

the at least one lock being configured to secure the support and the first part when the distance separating the first part and the second part becomes greater than the second threshold, and to detach the support from the first part when the distance separating the first part and the second part becomes less than or equal to the second threshold.

According to an aspect of the invention, the first line is intended to connect the electrical apparatus to or disconnect the electrical apparatus from a power and/or current source;

According to an aspect of the invention, the second line is intended to connect the electrical apparatus to or disconnect the electrical apparatus from a test and/or control equipment;

According to an aspect of the invention, in the second operating area, the contact is maintained between the at least one first pole belonging to the second line and the at least one second pole belonging to the second line without relative displacement or sliding with respect to each other.

According to an aspect of the invention, in the second operating area, the securing between the support and the second part is ensured by the friction to the contact between the at least one first pole belonging to the second line and the at least one second pole belonging to the second line.

According to an aspect of the invention, at least one second lock allows securing the support and the second part.

Thanks to this arrangement, the securing between the support and the second part is ensured even when the friction to the contact between the at least one first pole belonging to the second line and the at least one second pole belonging to the second line is not sufficient to ensure this securing in the second operating area.

It is then necessary to detach the support and the second part in order to ensure the transition to the third operating area and open the second line.

According to an aspect of the invention, the first part is a face of a movable slide member, and the second part is a planar portion of a stationary cabinet.

According to an aspect of the invention, the at least one lock is carried by the support.

According to an aspect of the invention, the at least one second lock is carried by the support.

According to an aspect of the invention, the at least one first pole belonging to the first line is a pole of an electrical socket fixed to the first part and the at least one second pole belonging to the first line is a pole of an electrical socket fixed to the second part.

According to an aspect of the invention, the at least one first pole belonging to the first line is a male pole of a first male electrical socket, and the at least one second pole belonging to the first line is a female pole of a second female electrical socket.

According to an aspect of the invention, the first electrical socket is configured so that the apparatus can be electrically joined to the at least one first pole belonging to the first line, and the second electrical socket is configured so that the at least one second pole belonging to the first line is electrically joined to the electrical current source.

According to an aspect of the invention, the at least one second pole belonging to the second line is a pole of a connector fixed to the second part.

According to an aspect of the invention, the at least one second pole belonging to the second line is a female pole of a female connector and the at least one first pole belonging to the second line is a male pole.

According to an aspect of the invention, the device further comprises at least one extension, one end of which cooperates with the at least one lock of the support to detach the support from the first part when the distance separating the first part and the second part becomes less than the second threshold.

According to an aspect of the invention, the at least one lock is a flexible portion of the support which disappears under the pressure of the end in order to detach the support from the first part.

According to an aspect of the invention, the end cooperates with the at least one second lock of the support to secure the support to the second part when the distance separating the first part and the second part becomes less than the second threshold.

According to an aspect of the invention, the second lock is a clip which cooperates with the end to secure the support to the second part.

According to an aspect of the invention, the support is configured to be inserted, at least partially, inside a guide box fixed to the first part, when the support is detached from the first part and the first part gets closer to the second part, and to be removed, at least partially, from the guide box when the first part deviates from the second part.

According to an aspect of the invention, the guide box cooperates with the support so that the distance separating the first part and the second part remains less than the second threshold when the at least one second pole belonging to the second line is in contact with the at least one first pole belonging to the second line.

Thanks to this arrangement, the support is never completely removed from its housing in the box.

BRIEF DESCRIPTION OF THE DRAWINGS

For its good understanding, the invention is described with reference to the drawings appended herein showing, by way of non-limiting example, an embodiment of a device according to the invention.

DETAILED DESCRIPTION

Figure 1:
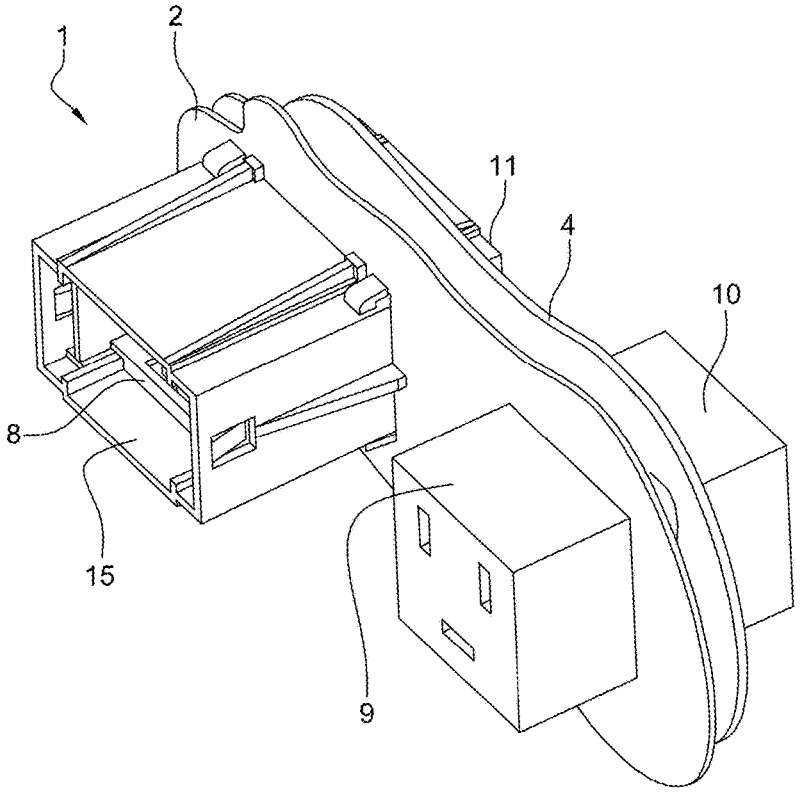
FIG. 1 is a perspective view of the device, shown in its first operating area where the two junction lines are simultaneously closed.

FIG. 1 is a perspective view of an embodiment of the invention, that is to say of an example of a device 1 for connecting and disconnecting an electrical apparatus to an electrical current source or to a control equipment, comprising a first part 2 which, according to an embodiment, is one of the faces of a movable slide member in a stationary cabinet. Said face of said slide member is planar and located opposite a face portion 4 inside the stationary cabinet; the face 2 of the slide member is movable with the slide member, in a connection/disconnection direction transverse to the plane containing the face of the slide member 2, and also transverse to the plane containing the face portion 4 of the stationary cabinet, these two planes being parallel.

Figure 2:
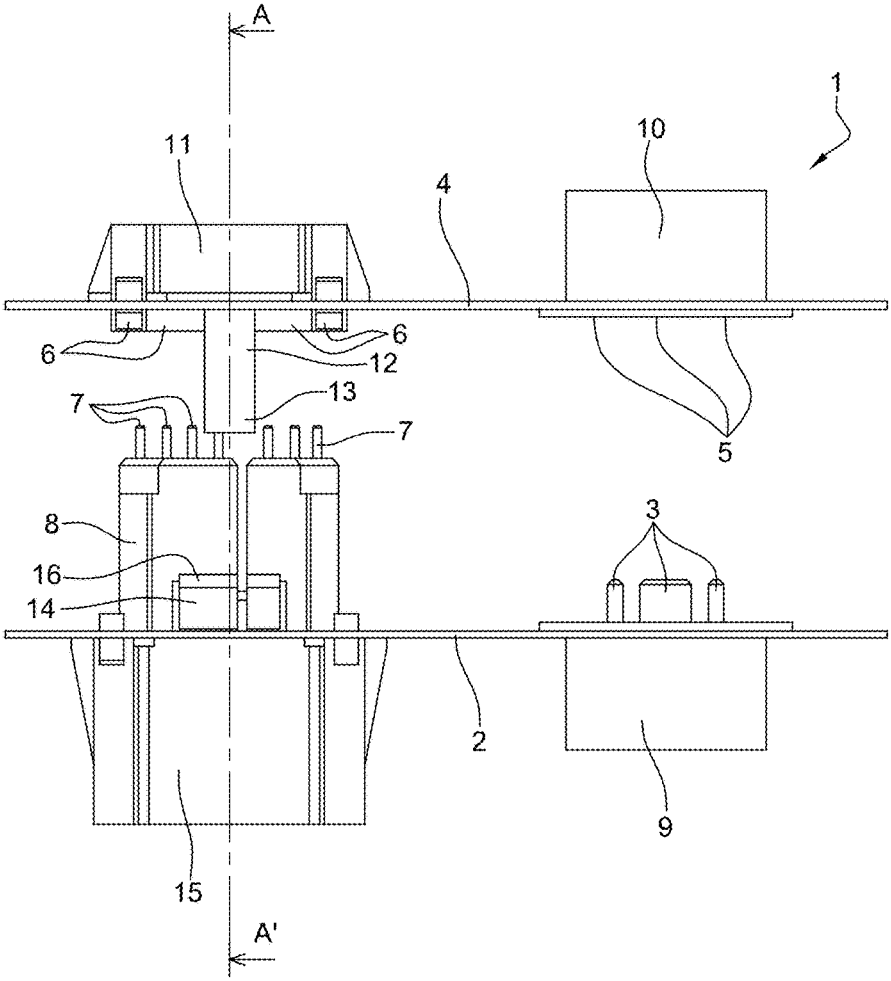
FIG. 2 is a top view of the device, shown in its third operating area where the two junction lines are simultaneously open.

FIG. 2 is a top view of the same embodiment of the invention, in a configuration where the face 2 of the movable slide member is deviated from the face portion 4.

On the face 2 of the movable slide member is fixed a socket 9 provided on a first side with female poles capable of being electrically joined with the electrical apparatus, and provided on the opposite side with male poles 3 in electrical contact with said female poles.

Opposite to this socket 9, a female socket 10 electrically joined to the electrical current source is fixed on the face portion 4 located on the stationary electrical cabinet; the female socket 10 is provided with female poles 5 corresponding to the male poles 3 of the socket 9; when the face 2 of the movable slide member is sufficiently close to the face portion 4, the contact is established between the socket 9 and the socket 10, such that a first power or supply line is closed between the apparatus and the current source.

On the face 2 of the movable slide member is also fixed a rectangular parallelepiped-shaped hollow box 15 open at each of its bases; one of its open bases is bearing on the face 2 of the slide member on which the box is fixed; an opening, similar in shape to that of the base of the box bearing on the face 2 of the slide member, is hollowed-out on the face 2 of the slide member, in order to extend the opening of the box by passing through the face 2 of the slide member. A rectangular parallelepiped-shaped support 8 is formatted to be inserted, in the direction of its length, inside the box 15, configured to guide the movement of the movable support 8. When the support 8 is inserted into the box 15, a first end, in the direction of the length of the support 8, is located on the side of the opening hollowed-out on the face 2 of the slide member, a second end being located on the side of the second open base of the box 15, opposite to the opening hollowed-out on the face 2 of the slide member. On its first end, the one disposed on the side of the opening hollowed-out on the face 2 of the slide member, the support 8 carries the male poles 7 intended to come into contact with the female poles 6 of a connector 11 of the control equipment. The support 8 is configured to allow, through the second open base of the box 15, joining the apparatus to be controlled, to the male poles 7 fixed on the support 8.

Opposite to the support 8 inserted inside the box 15, and male poles 7 carried by the support 8, a female connector 11 is fixed on the face portion 4. When the male poles 7 are inserted into the corresponding female poles 6 of the connector 11, and when the electrical apparatus is joined to the male poles 7 of the support 8, then the second line is closed, which allows establishing the electrical contact between the apparatus and a control equipment itself joined to the connector 11.

The support 8 is provided, on two of its opposite faces, with a flexible portion 14, 14', acting as a spring one end of which deviates, when it is free, from the face on which the other end is fixed. This mechanism is better shown in FIGS. 5 and 6, which are views along a section plane AA' transverse to the plane of FIGS. 2, 3 and 4. When the support 8 reaches the end of its travel towards the outside of the guide box 15, as shown in FIG. 2 and FIG. 5, the spring 14, 14' is released on either side of the support 8 and bears on the edge of the box 15. The box 15 and the support 8 are, on the other hand, configured so that the support 8 cannot be completely removed from its guide box 15. In this configuration, the support 8 and the box 15 are thus secured to each other. The box 15 being itself fixed to the face portion 2 of the movable slide member, the support 8 is thus also secured to the face portion 2 of the movable slide member. In this configuration, the spring 14, 14' also acts as a lock.

Figure 3:
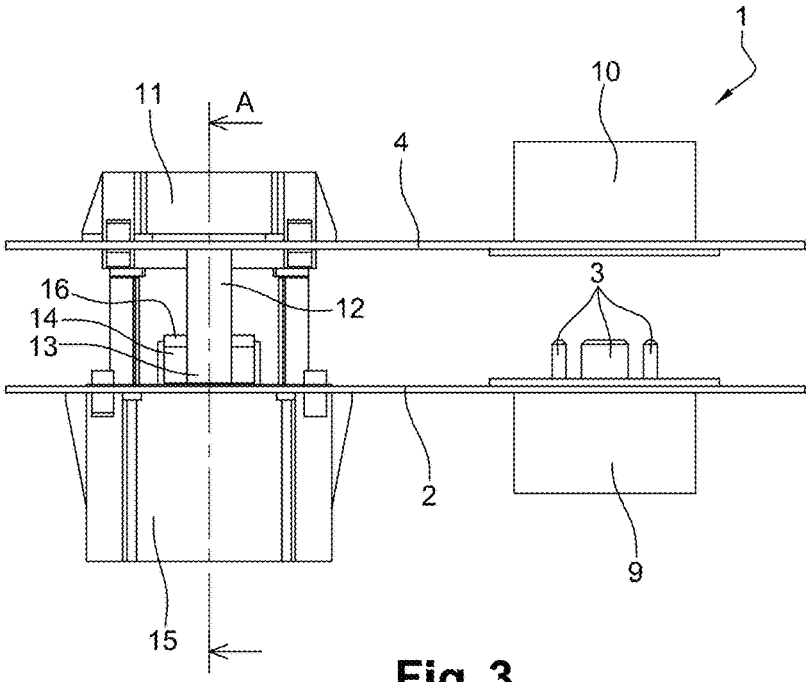
FIG. 3 is a top view of the device, shown in its second operating area where the power line is open and the test and/or control line is closed.
Figure 4:
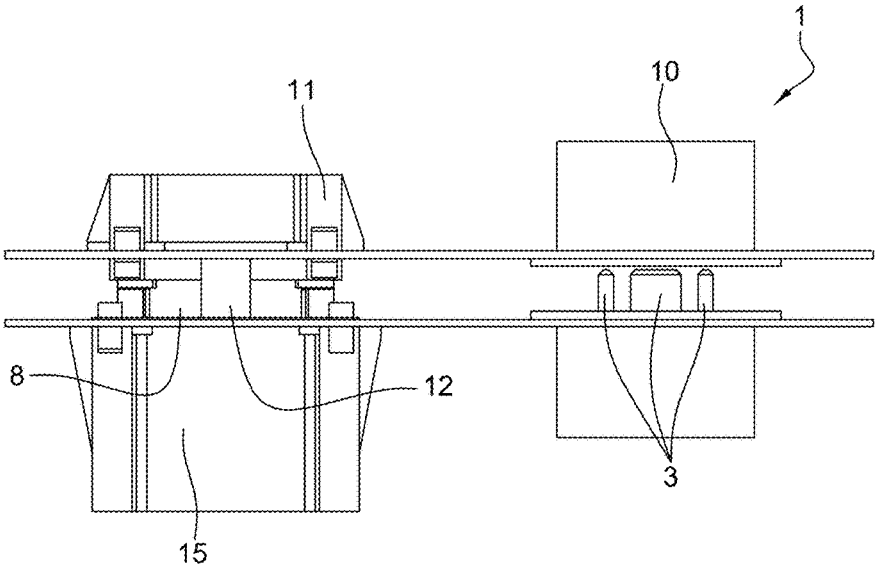
FIG. 4 is a top view of the device, shown at the transition between the first and second operating area.
Figure 5:
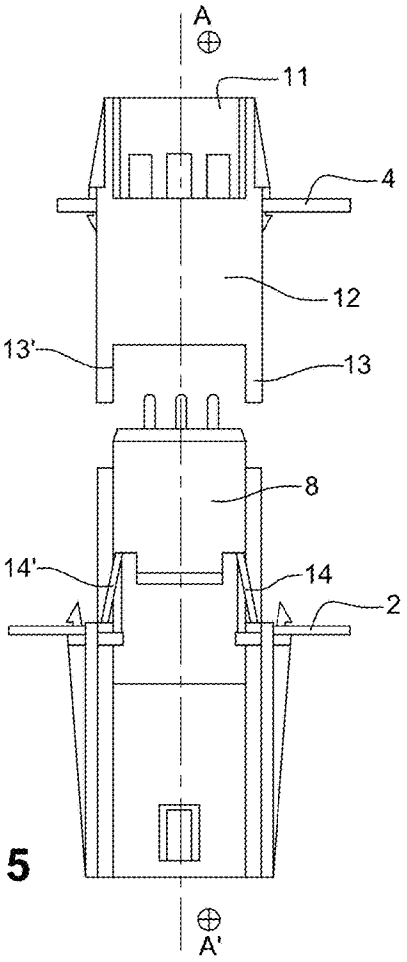
FIG. 5 is a view along a section plane AA' transverse to the plane of FIGS. 2, 3 and 4, the device being shown in its third operating area.
Figure 6:
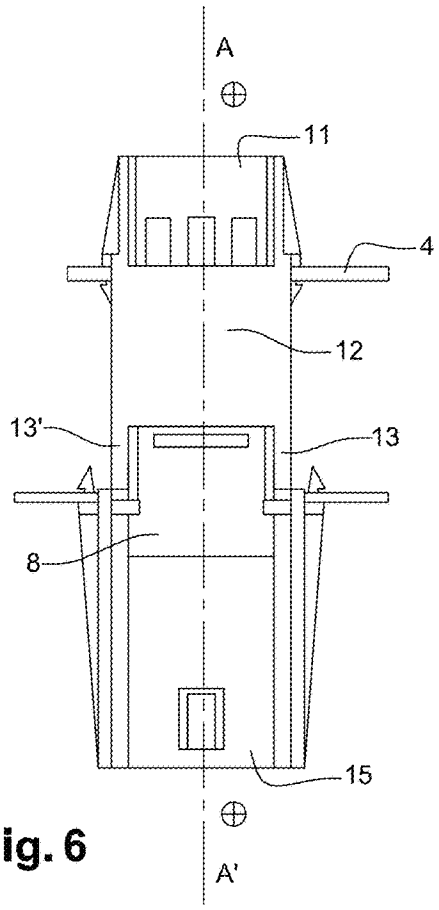
FIG. 6 is a view along a section plane AA' transverse to the plane of FIGS. 2, 3 and 4, the device being shown in its second operating area.

The connector 11 is provided with two extensions 12, only one of which is seen in the top views shown in FIGS. 2, 3 and 4; the two extensions are shown in FIGS. 5 and 6, which are views along a section plane AA' transverse to the plane of FIGS. 2, 3 and 4; when the male poles 7 of the support 8 are inserted into the corresponding female poles 6 of the connector 11, each extension 12 extends respectively along one of the two opposite faces of the support 8, which are provided with the spring 14, 14'. When the male poles 7 of the support 8 are inserted into the corresponding female poles 6 of the connector 11, an end 13, 13' of each extension 12 is configured to cooperate with the spring 14, 14' to exert a pressure on this spring in order to press it over the considered face of the support 8; this pressure exerted by the end 13, 13' of the extension 12 unlocks the support 8 and detaches it from the face portion 2 of the movable slide member, thus allowing the support 8 to be inserted again inside its guide box 15.

Thus, according to this first embodiment of the device 1 according to the invention, three operating areas of the device may be distinguished, according to the distance separating the face portion 2 of the movable slide member and the face portion 4 of the stationary cabinet.

A first operating area, illustrated in FIG. 1, in which the power or supply male poles 3 are in contact with the power or supply female poles 5 so as to close the first line to connect the apparatus on the electrical current source, while the test and/or control male poles 7 are in contact with the test and/or control female poles 6 so as to close the second line to connect the apparatus to the control equipment; this operating area is characterized by a distance separating the face portion 2 of the movable slide member and the face portion 4 of the stationary cabinet less than a first threshold, equal to the length of the male poles 3.

A second operating area, illustrated in FIG. 3, in which the power or supply male poles 3 are separated from the power or supply female poles 5 so as to open the first line to disconnect the apparatus from the electrical current source, while the test and/or control male poles 7 are in contact with the test and/or control female poles 6 so as to close the second line to connect the apparatus to the control equipment; this operating area is characterized by a distance separating the face portion 2 of the movable slide member and the face portion 4 of the stationary cabinet comprised between a first threshold, equal to the length of the male poles 3, and a second threshold determined by the length of the portion of the support 8 which may be removed from its guide box 15.

A third operating area, illustrated in FIG. 2, in which the power or supply male poles 3 are separated from the power or supply female poles 5 so as to close the first line to disconnect from the apparatus on the electrical current source, while the test and/or control male poles 7 are also separated from the test and/or control female poles 6 so as to open the second line to disconnect the apparatus from the control equipment; this operating area is characterized by a distance separating the face portion 2 of the movable slide member and the face portion 4 of the stationary cabinet greater than the second threshold.

During the displacement of the movable slide member which allows passing from the first operating area to the second operating area, as illustrated by FIG. 4, the support 8 is made secured to the connector 11 by the effect of the friction between the male poles 7 of the support 8 and the female poles 6 of the connector 11. The support 8 thus attached to the connector 11 is gradually removed from its guide box 15, which is secured to the movable slide member.

During this movement, the contact is maintained between the male poles 7 of the support 8 and the female poles 6 of the connector 11 without relative sliding of the male poles 7 with respect to the female poles 6.

The movement of removal of the support 8 from its guide box 15 continues until the locks 14, 14' located on either side of the support 8 are removed from the box 15. At this time, the support 8 is retained by the guide box 15 which is configured to prevent the support 8 from being more completely removed from the guide box. If the traction force exerted on the slide member is sufficient to be opposed to the friction between the male poles 7 of the support 8 and the female poles 6 of the connector 11, the device enters its third operating area.

According to a second embodiment of the invention, a portion 16 of the spring 14 and the end 13 of the extension 12 are arranged to cooperate so as to secure the support 8 and the connector 11 when the male poles 7 of the support 8 are inserted into the corresponding female poles 6 of the connector 11. The support is then also secured to the face portion 4 of the stationary cabinet on which the connector 11 is fixed.

This arrangement has the advantage of making the partial removal of the support 8 from its guide box 15, independent of the friction, more or less significant, between the male poles 7 of the support 8 and the female poles 6 of the connector 11. In order to allow the device to pass from its second operating area to its third operating area, the portion 16 of the spring 14 and the end 13 of the extension 12 are arranged so that a sufficient traction force exerted on the movable slide member allows detaching the connector 11 from the support 8. According to the second embodiment, the end 13 of the extension 12 can for example be clipped on the portion 16 of the spring 14.

The invention claimed is:

1. A device for connecting and disconnecting an electrical apparatus by a first line and a second line, the device comprising:

a first part, carrying at least one first pole belonging to the first line;

a second part, carrying at least one second pole belonging to the first line;

the first part being movable relative to the second part in a connection and disconnection direction;

a movable support guided in movement relative to the first part, the support carrying at least one first pole belonging to the second line;

the second part carrying at least one second pole belonging to the second line;

at least one lock for securing the support with respect to the first part;

the connection and disconnection device defining a first operating area in which:

the at least one first pole belonging to the first line is in contact with the at least one second pole belonging to the first line so as to close the first line, and the at least one first pole belonging to the second line is in contact with the at least one second pole belonging to the second line so as to close the second line, the distance separating the first part from the second part being less than a first threshold;

the connection and disconnection device defining a second operating area in which:

the at least one first pole belonging to the first line is separated from the at least one second pole belonging to the first line so as to open the first line, and the at least one first pole belonging to the second line is in contact with the at least one second pole belonging to the second line so as to close the second line, the distance separating the first part from the second part being comprised between the first threshold and a second threshold;

the connection and disconnection device defining a third operating area in which:

the at least one first pole belonging to the first line is separated from the at least one second pole belonging to the first line so as to open the first line, and the at least one first pole belonging to the second line is separated from the at least one second pole belonging to the second line so as to open the second line, the distance separating the first part from the second part being greater than the second threshold;

the at least one lock being configured to secure the support and the first part when the distance separating the first part and the second part becomes greater than the second threshold, and to detach the support from the first part when the distance separating the first part and the second part becomes less than or equal to the second threshold.

2. The device according to claim 1, wherein the first part is a face of a movable slide member, and the second part is a planar portion of a stationary cabinet.

3. The device according to claim 1, wherein the at least one lock is carried by the support.

4. The device according to claim 1, wherein the at least one first pole belonging to the first line is a pole of an electrical socket fixed to the first part and the at least one second pole belonging to the first line is a pole of an electrical socket fixed to the second part.

5. The device according to claim 1, wherein the at least one second pole belonging to the second line is a pole of a connector fixed to the second part.

6. The device according to claim 1, further comprising at least one extension, one end of which cooperates with the at least one lock of the support to detach the support from the first part when the distance separating the first part and the second part becomes less than the second threshold.

7. The device according to claim 6, wherein the support is configured to be inserted, at least partially, inside a guide box fixed to the first part, when the support is detached from the first part and the first part gets closer to the second part, and to be removed, at least partially, from the guide box when the first part deviates from the second part.

8. The device according to claim 7, wherein the guide box cooperates with the support so that the distance separating the first part and the second part remains less than the second threshold when the at least one second pole belonging to the second line is in contact with the at least one first pole belonging to the second line.

9. The device according to claim 2, wherein the at least one lock is carried by the support.

10. The device according to claim 2, wherein the at least one first pole belonging to the first line is a pole of an electrical socket fixed to the first part and the at least one second pole belonging to the first line is a pole of an electrical socket fixed to the second part.

11. The device according to claim 3, wherein the at least one first pole belonging to the first line is a pole of an electrical socket fixed to the first part and the at least one second pole belonging to the first line is a pole of an electrical socket fixed to the second part.

12. The device according to claim 9, wherein the at least one first pole belonging to the first line is a pole of an electrical socket fixed to the first part and the at least one second pole belonging to the first line is a pole of an electrical socket fixed to the second part.

13. The device according to claim 2, wherein the at least one second pole belonging to the second line is a pole of a connector fixed to the second part.

14. The device according to claim 3, wherein the at least one second pole belonging to the second line is a pole of a connector fixed to the second part.

15. The device according to claim 4, wherein the at least one second pole belonging to the second line is a pole of a connector fixed to the second part.

16. The device according to claim 9, wherein the at least one second pole belonging to the second line is a pole of a connector fixed to the second part.

17. The device according to claim 10, wherein the at least one second pole belonging to the second line is a pole of a connector fixed to the second part.

18. The device according to claim 11, wherein the at least one second pole belonging to the second line is a pole of a connector fixed to the second part.

19. The device according to claim 12, wherein the at least one second pole belonging to the second line is a pole of a connector fixed to the second part.

20. The device according to claim 19, further comprising at least one extension, one end of which cooperates with the at least one lock of the support to detach the support from the first part when the distance separating the first part and the second part becomes less than the second threshold.

* * * * *